US008725033B2

(12) United States Patent
Nakajima et al.

(10) Patent No.: US 8,725,033 B2
(45) Date of Patent: May 13, 2014

(54) IMAGE FORMING DEVICE HAVING DETACHABLE PROCESS UNIT

(75) Inventors: Keigo Nakajima, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/547,584

(22) Filed: Jul. 12, 2012

(65) Prior Publication Data

US 2012/0275825 A1 Nov. 1, 2012

Related U.S. Application Data

(63) Continuation of application No. 12/411,803, filed on Mar. 26, 2009, now Pat. No. 8,229,318.

(30) Foreign Application Priority Data

May 29, 2008 (JP) ..... 2008-140377

(51) Int. Cl.
*G03G 15/00* (2006.01)

(52) U.S. Cl.
USPC ..... 399/110

(58) Field of Classification Search
USPC ..... 399/107–114, 119, 120, 252, 258, 260, 399/262
See application file for complete search history.

(56) References Cited

U.S. PATENT DOCUMENTS

| | | | |
|---|---|---|---|
| 6,418,292 | B1 | 7/2002 | Isobe et al. |
| 6,564,029 | B2 * | 5/2003 | Kojima et al. ..... 399/258 |
| 7,020,416 | B2 | 3/2006 | Kato et al. |
| 7,187,876 | B2 | 3/2007 | Ito et al. |
| 7,409,181 | B2 | 8/2008 | Yahagi |
| 7,457,569 | B2 | 11/2008 | Kawai |
| 2006/0028131 | A1 | 2/2006 | Kimura et al. |

FOREIGN PATENT DOCUMENTS

| | | |
|---|---|---|
| JP | 04-095980 | 3/1992 |
| JP | 08-001956 | 1/1996 |
| JP | 08-320617 | 12/1996 |
| JP | 2004-171033 | 6/2004 |
| JP | 2005-338583 | 12/2005 |
| JP | 2006-292982 | 10/2006 |

OTHER PUBLICATIONS

Office action for Japanese patent application No. 2011-173635 mailed Dec. 6, 2011.
Decision of Rejection for Japanese patent application No. 2008-140377 mailed May 10, 2011.

(Continued)

*Primary Examiner* — Hoan Tran
(74) *Attorney, Agent, or Firm* — Banner & Witcoff, Ltd.

(57) ABSTRACT

An image forming device facilitating fluid communication between developer cartridges supported in a main body frame and a process unit in which developing units are accommodated in a drawer movable in a first direction and second direction opposite to the first direction. The developing units are arrayed in the first and second direction, and the process unit is formed with communication ports displaced from one another in a direction perpendicular to the first and second direction. An inlet shutter mechanism is provided to open the communication ports when the drawer is assembled to an operable position for image formation. The main body has abutment portions to open each shutter of the inlet shutter mechanism in accordance with the movement of the drawer to the operable position.

18 Claims, 15 Drawing Sheets

(56) References Cited

OTHER PUBLICATIONS

Japanese office action mailed Dec. 28, 2010 in application No. 2008-140377.

Office action in corresponding Japanese appliction 2008-140377 mailed Sep. 28, 2010.

Office action in corresponding Japanese application 2008-140377 mailed Jul. 20, 2010.

* cited by examiner

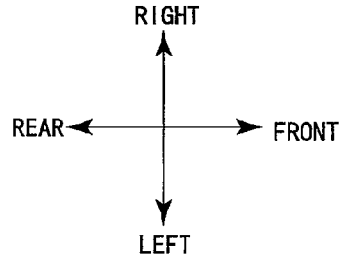
Fig. 7(a)
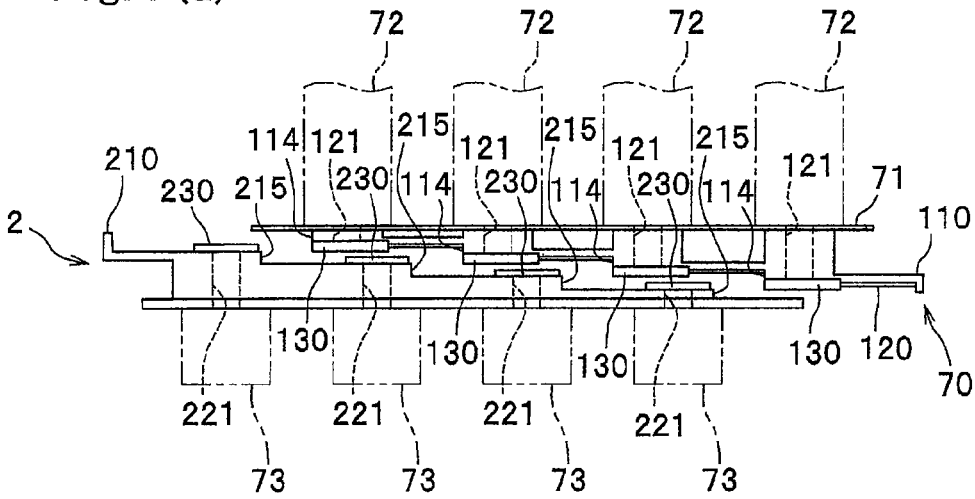
Fig. 7(b)
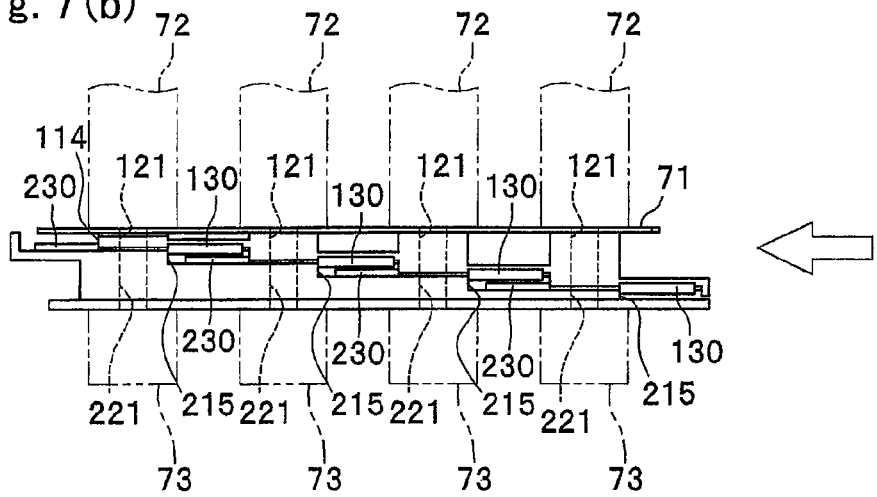

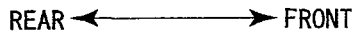
Fig. 14(a)
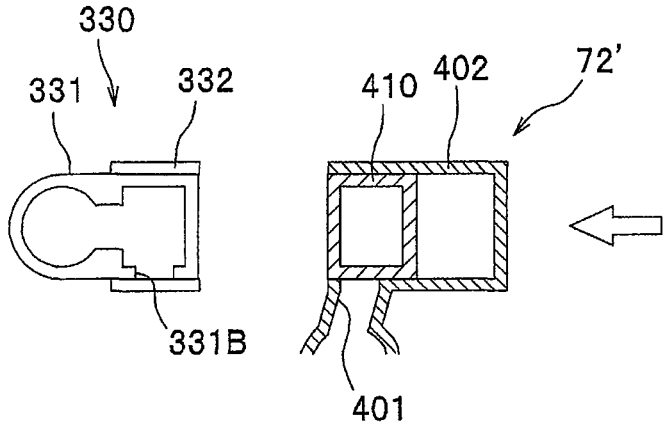
Fig. 14(b)
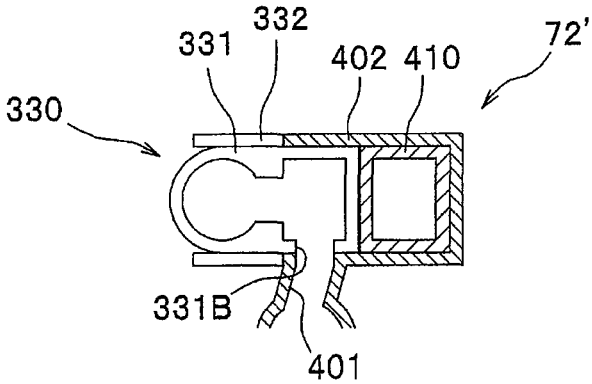

IMAGE FORMING DEVICE HAVING DETACHABLE PROCESS UNIT

CROSS REFERENCE TO RELATED APPLICATION

This application is a continuation of and claims priority from U.S. patent application Ser. No. 12/411,803 filed Mar. 26, 2009 and Japanese Patent Application No. 2008-140377 filed May 29, 2008. The entire contents of the aforementioned applications are incorporated herein by reference.

TECHNICAL FIELD

The present invention relates to an image forming device having a plurality of developer cartridges and a process unit where a plurality of developing units each receiving developing agent (toner) from each developer cartridge are integrally supported.

BACKGROUND

In a conventional electrical photographic type image forming device, an electrically charged photosensitive drum is exposed to light to change electrical potential at light irradiated portions to provide an electrostatic latent image, and a developing agent image (toner image) corresponding to the electrostatic latent image is formed by supplying toner onto the photosensitive drum. The toner image is then transferred onto an image recording sheet to provide a visible image on the sheet.

In such conventional image forming device as described in laid open Japanese patent application publication No. 2006-292982, a process unit is provided in which a plurality of developing units are arrayed in a predetermined direction, and the process unit is detachable with respect to a frame of the image forming device in the direction of the array of the developing units. Each developing unit is adapted to supply developing agent to each photosensitive drum.

A plurality of developer cartridges containing toners different from one another in color are provided each supplying developing agent to each associated one of the developing units. More specifically, each developer cartridge has a toner outlet port, and each developing unit has a toner inlet port so as to receive toner from the toner outlet port.

Such plurality of developer cartridges can be detachably attached to the frame independent of the process unit. Since the process unit is detachably movable with respect to the frame in a direction of an array of the developing units, fluid connection between each toner outlet port and each toner inlet port may be insufficient in accordance with movement of the process unit.

SUMMARY

In view of the foregoing, it is an object of the invention to provide an image forming device capable of ensuring fluid connection between each toner outlet port and each toner inlet port between a plurality of developer cartridges and a plurality of developing units.

This and other objects of the invention will be attained by an image forming device including a stationary main body, a photosensitive body, a plurality of developer cartridges, a process unit, an inlet shutter mechanism, and a set of first abutment portions. The photosensitive body has a surface on which an electrostatic latent image is formed. Each of the plurality of developer cartridges is detachably attached to the main body and retains therein developing agent. A plurality of first communication ports are formed in one of the stationary main body and developer cartridges. The developing agent is supplied from each developer cartridge through each first communication port. The process unit includes a plurality of developing units and a support member. The plurality of developing units is arrayed in a first direction and each developing unit is configured to supply developing agent to the photosensitive body. The support member accommodates therein an array of the plurality of developing units and is movable in the first direction and a second direction opposite to the first direction relative to the main body. The support member is position-fixable to the main body at an operable position for image formation. The plurality of first communication ports is offset from one another in a third direction perpendicular to the first and second directions, and the process unit has a plurality of second communication ports offset from one another in the third direction and aligned with the plurality of first communication ports at the operative position. The inlet shutter mechanism is disposed at the process unit and has a plurality of inlet shutters each movable in the first direction and the second direction between a first open position allowing fluid communication between each first communication port and each second communication port and a first closed position shutting off the fluid communication. The set of first abutment portions is provided at the main body and each abuttable on each inlet shutter to move each inlet shutter to each first open position in accordance with the movement of the process unit in the first direction toward the operative position.

In another aspect of the invention, there is provided a fluid coupling device for simultaneously supplying fluids in a plurality of supply cartridges to a plurality of receiving cartridges each associated with corresponding one of the supply cartridges. The fluid coupling device includes a stationary main body, a movable unit, an inlet shutter mechanism, and a set of first abutment portions. The plurality of supply cartridges are assembled to the main body. One of the stationary main body and supply cartridges has a plurality of outlet ports for supplying fluids to the plurality of receiving cartridges. The movable unit is movable in a first direction and a second direction opposite to the first direction relative to the stationary main body, and is attachable to the stationary main body at an operative position. The movable unit accommodates therein the plurality of receiving cartridges. The plurality of outlet ports is offset from one another in a third direction perpendicular to the first and second directions. The movable unit has a plurality of inlet ports offset from one another in the third direction and aligned with the plurality of outlet ports at the operative position. The inlet shutter mechanism is disposed at the movable unit and has a plurality of inlet shutters each movable in the first direction and the second direction between a first open position allowing fluid communication between each outlet port and each inlet port and a first closed position shutting off the fluid communication. The set of first abutment portions is provided at the main body and each abuttable on each inlet shutter to move each inlet shutter to each first open position in accordance with the movement of the movable unit in the first direction toward the operative position.

BRIEF DESCRIPTION OF THE DRAWINGS

In the drawings;

FIG. 2(*b*) is a schematic plan view showing a layout of developer cartridges, the drawer, and developing units in a main frame according to the first embodiment;

FIG. 3(*b*) is a perspective view showing an open state of the inlet shutter mechanism in the printer according to the first embodiment;

FIG. 4(*b*) is a perspective view showing an open state of the outlet shutter mechanism in the printer according to the first embodiment;

FIG. 7(*a*) is a view for description of each shutter prior to abutment onto a base member in the printer according to the first embodiment;

FIG. 7(*b*) is a view for description of each shutter after abutment onto the base member in the printer according to the first embodiment;

FIG. 11(*b*) is a perspective view of a shutter mechanism in the printer according to the second embodiment;

FIG. 14(*a*) is an enlarged cross-sectional view showing a shutter prior to abutment onto a shutter support portion in the printer according to the second embodiment; and, FIG. 14(*b*) is an enlarged cross-sectional view showing the shutter after abutment onto the shutter support portion in the printer according to the second embodiment.

DETAILED DESCRIPTION

Figure 1:
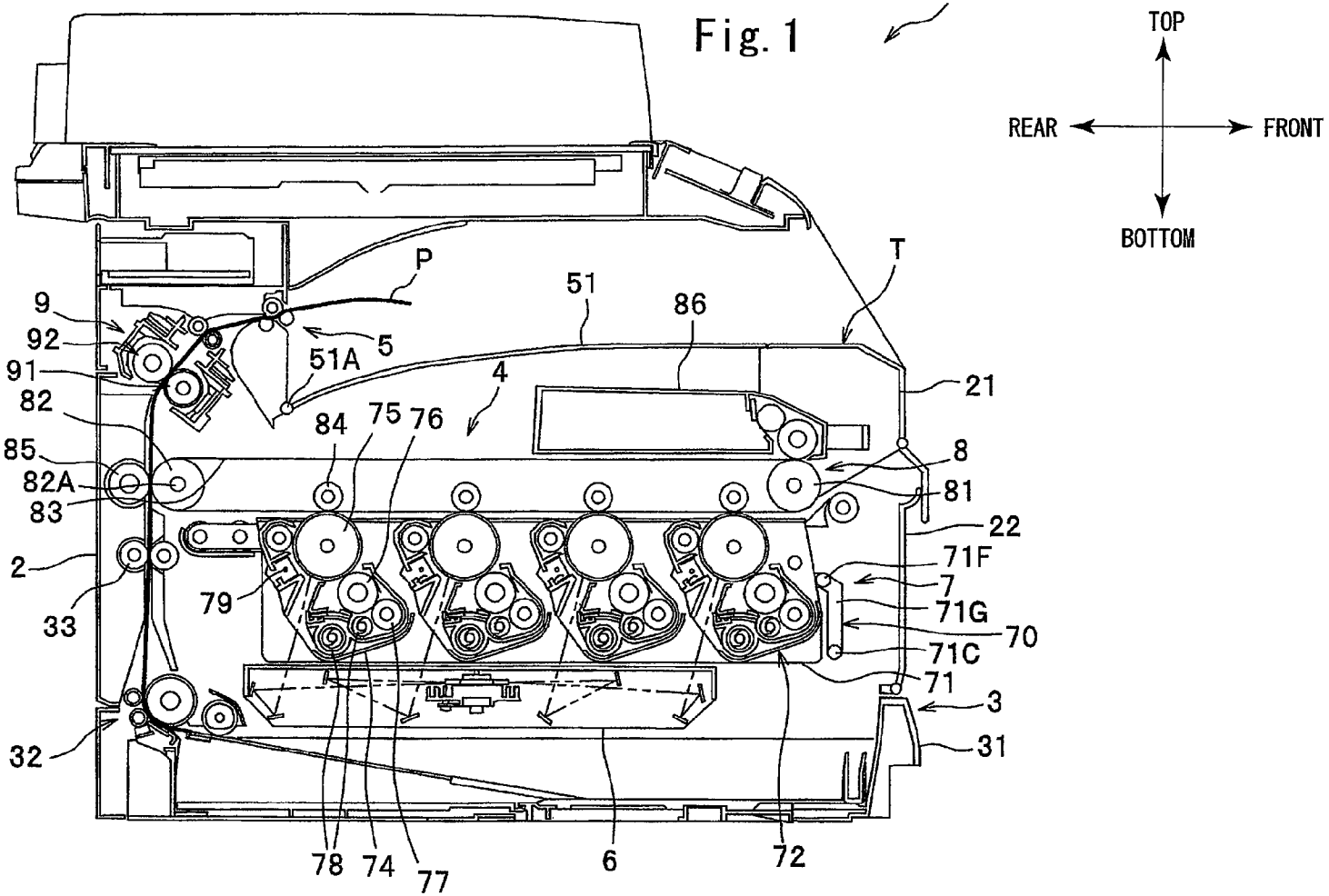
FIG. 1 is a schematic cross-sectional view of a color laser printer embodying an image forming device according to a first embodiment of the present invention.

A color laser printer as an image forming device according to a first embodiment of the present invention will be described with reference to FIGS. 1 through 8. As shown in FIG. 1, a color laser printer 1 has a main frame 2 constituting a main body. Within the main frame 2, a sheet supply section 3 for supplying a sheet P, an image forming section 4 for forming an image onto the sheet P supplied from the sheet supply section 3, and a discharge section 5 for discharging the sheet P formed on the image to an outside of the main frame 2 are provided.

Throughout the specification, the terms "above", "below", "right", "left", "front", "rear" and the like will be used assuming that the image forming device is disposed in an orientation in which it is intended to be used. More specifically, in FIG. 1 a left side and a right side are a rear side and a front side, respectively.

The main frame 2 has a top cover T, a first front cover 21, and a second front cover 22. The top cover T is pivotally connected to the main frame 2 by a pivot shaft 51A and is pivotally movable upward and downward. The first front cover 21 is positioned at a front side of the main frame 2, and is pivotally movably provided. The second front cover 22 is positioned immediately below the first front cover 21, and has a lower end pivotally connected to the main frame 2.

The sheet supply section 3 includes a sheet supply tray 31, a sheet supply mechanism 32 for conveying the sheet P from the sheet supply tray 31 to the image forming section 4, and registration roller 33. The sheet supply tray 31 is detachably mounted at a lower portion of the main frame 2. The sheet supply mechanism 32 includes a sheet supply roller, a separation roller, a separation pad, and a paper-dust removing roller. Each sheet P accommodated in the sheet supply tray 31 is directed upwardly to the registration roller 33 by the sheet supply mechanism 32, and orientation of the sheet P is corrected by the registration roller 33. Then, the sheet P is conveyed upwardly to the image forming section 4.

The image forming section 4 includes a scanning section 6, a process section 7, a transfer section 8, and a fixing section 9. The scanning section 6 is positioned at a lower portion of the main frame 2 between the sheet supply tray 31 and the process section 7. The scanning section includes a laser emission unit, polygon mirror, a plurality of lenses, and a reflecting mirror. The laser emission units are adapted to project laser beams for each of the colors cyan, magenta, yellow, and black onto respective photosensitive drums 75 in the process section 7 described later.

Figure 2A:
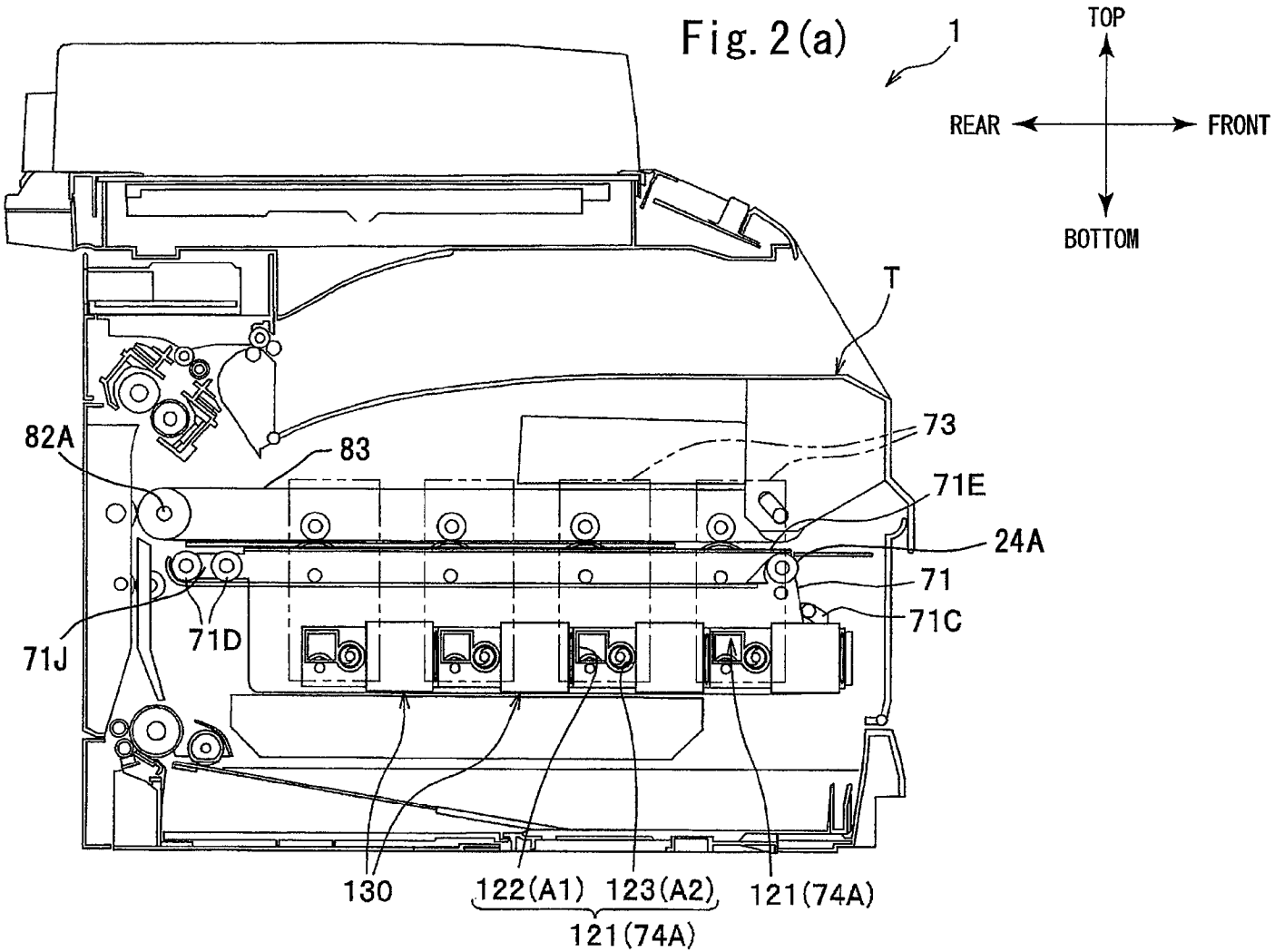
FIG. 2(*a*) is a cross-sectional view particularly showing openings of a drawer in the color laser printer according to the first embodiment.
Figure 2B:
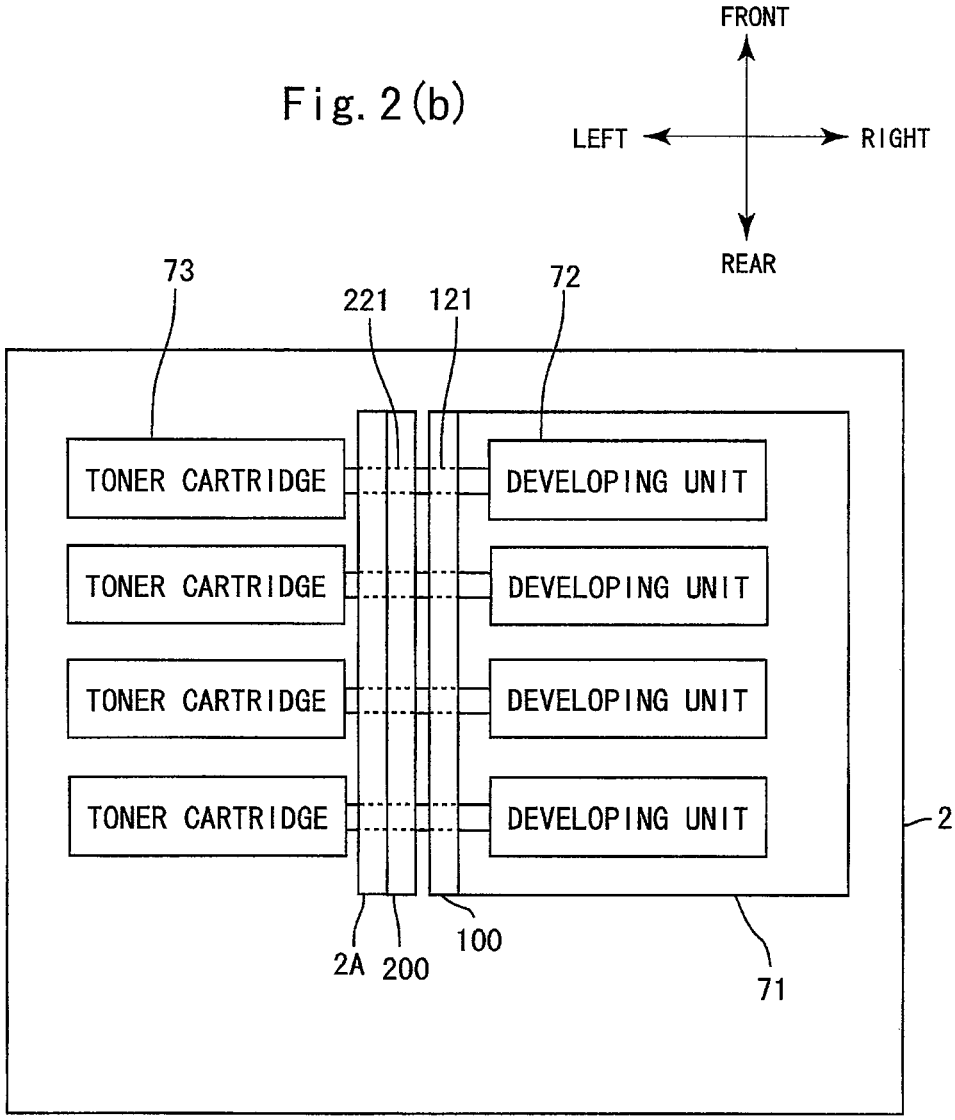

The process section 7 is disposed immediate above the scanning section 6 and below the transfer section 8. The process section 7 includes a process unit 70 detachably movable with respect to the main frame 2, and a plurality of developer cartridges 73 detachably mounted in the main frame 2 and disposed at a left side of the process unit 70 as shown in FIG. 2(*b*). The "detachably movable" implies that the process unit 70 can be displaced from a predetermined fixed or operable position (image forming position) or can be completely taken out of the main frame 2. The plurality of the developer cartridges 73 retain therein developing agent (toner) different from one another in color.

The process unit 70 includes a drawer or a support member 71, and a plurality of developing units 72 arrayed inside the drawer 71. The drawer 71 is movable in the frontward/rearward direction relative to the main frame 2 between the operable position capable of performing image formation and a non-operable position offset from the operable position. The frontward direction is a pull-out direction to move away from the operable position, and rearward direction is a push-in direction to reach the operable position. The non-operable position includes a position where a part of the drawer 71 is still supported to the main frame 2, and another position where an entire drawer 72 is taken out of the main frame 2. The plurality of (four) developing units 72 are juxtaposed in the frontward/rearward direction and accommodated in the drawer 71. The drawer 71 has a plurality of passages 121 as described later.

Each developing unit 72 generally includes a developing case 74, the photosensitive drum 75 disposed in the developing case 74, a developing roller 76, a toner supply roller 77, a pair of augers 78, and a charger 79. Each developing case 74 has a left side wall where openings 74A (including openings A1 and A2) are formed. These openings A1, A2 are in direct confrontation and aligned with the openings of the passages 121 formed on the drawer 71 as shown in FIG. 2(*a*). Thus, the developing agent can be moved between the developer cartridge 73 and the developing case 74 via the passages 121 and the openings 74A.

With the process section 7 having the above construction, the charger 79 applies a positive charge to the surface of the photosensitive drum 75. Irradiating the charged surface on the photosensitive drum 75 with a laser beam lowers the potential in the exposed areas, thereby forming an electrostatic latent image on the photosensitive drum 75 based on image data. The developing agent retained in the developer cartridge 73 is supplied to the developing unit 72 through the passage 121 and opening A1, and the developing agent supplied to the developing unit 72 is conveyed to the developing roller 76 by the auger 78 and the toner supply roller 77. The positively charged developing agent is supplied from the developing roller 76 to the photosensitive drum 75, thereby developing the electrostatic latent image into a visible toner image. A part of developing agent in the developing unit 72 is returned by the auger 78 via the passage 121 and opening A2.

The transfer section 8 includes a drive roller 82, a follower roller 81, an endless intermediate transfer belt 83, a primary transfer roller 84, a secondary transfer roller 85, and cleaning unit 86. The drive roller 82 is rotatable about an axis of a rotation shaft 82A. The drive roller 82 and follower roller 81 are arranged parallel to each another and spaced away from each other in the frontward/rearward direction. The endless intermediate transfer belt 83 is looped around the drive roller 82 and the follower roller 81. The intermediate transfer belt 83 is circularly movable by the rotation of the drive roller 82.

The primary transfer rollers 84 are disposed at an inner peripheral side of the intermediate transfer belt 83, and pinch the intermediate transfer belt 83 in cooperation with the photosensitive drums 75. A transfer bias (negatively charged) is applied to the primary transfer roller 84 by a high voltage board (not shown), thereby transferring the toner image respectively formed on the photosensitive drums 75 to the intermediate transfer belt 83 in superposed fashion.

The secondary transfer roller 85 is located at a position rearward of the drive roller 82. The transfer bias (negatively charged) is applied to the secondary transfer roller 85 by the high voltage board (not shown), thereby transferring the toner image carried on the intermediate transfer belt 83 onto the sheet P upwardly conveyed from the registration roller 33.

Figure 5:
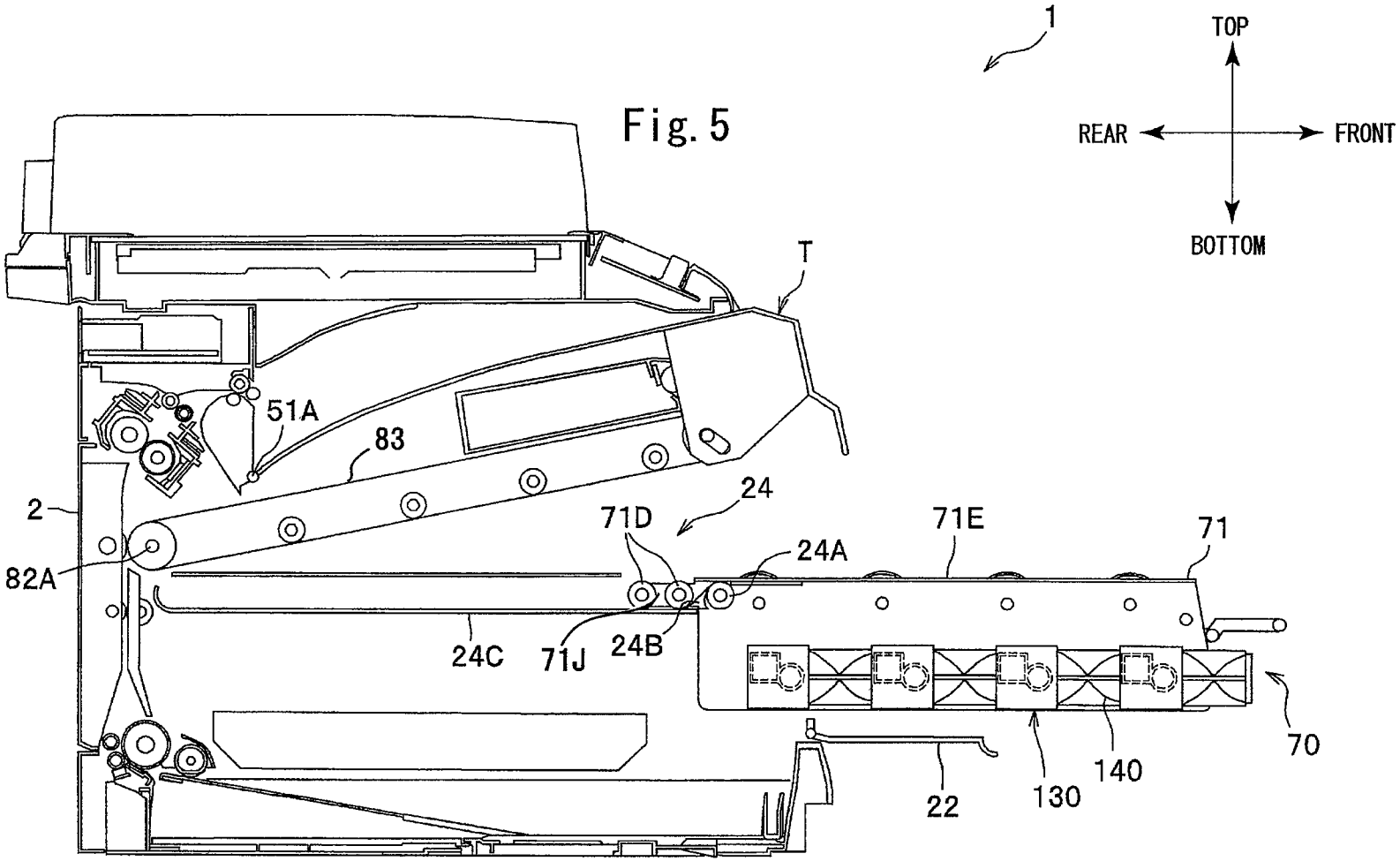
FIG. 5 is a schematic cross-sectional view showing a state prior to assembly of the drawer into the main frame in the printer according to the first embodiment.
Figure 6:
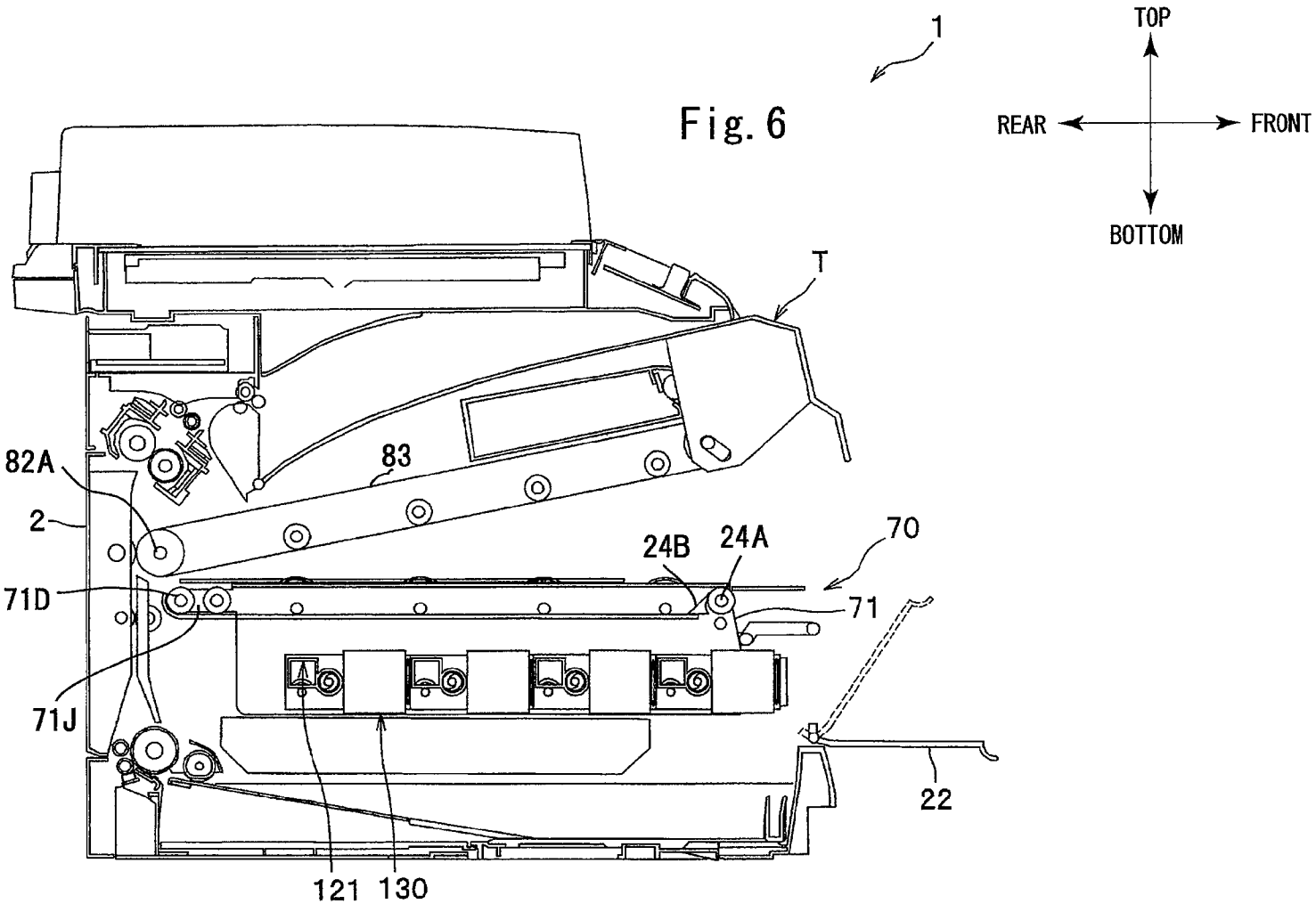
FIG. 6 is a schematic cross-sectional view showing a state after assembly of the drawer into the frame in the printer according to the first embodiment.

The cleaning unit 86 is disposed immediately above the intermediate transfer belt 83 for recovering the toner attached on the intermediate transfer belt 83 and retaining the recovered toner therein. The cleaning unit 86 can be exchanged with a new cleaning unit by pivotally opening the first front cover 21. The transfer section 8 excluding the secondary transfer roller 85 is supported by the top cover T, and is pivotally movable upward and downward about an axis of the rotation shaft 82A as shown in FIG. 5 upon pivotal movement of the top cover T about the axis of the pivot shaft 51A.

The fixing section 9 is provided at a position downstream of the transfer section 8, i.e., above the secondary transfer roller 85, and includes a heat roller 91 and a pressure roller 92. The toner image is thermally fixed on the sheet P by heat and pressure as the sheet P passes between the heat roller 91 and the pressure roller 92.

The discharge section 5 includes a plurality of conveying rollers and a discharge tray 51 provided at an upper portion of the top cover T. The conveying rollers are adapted for transferring the sheet P discharged from the fixing section 9 toward the discharge tray 51.

Figure 3A:
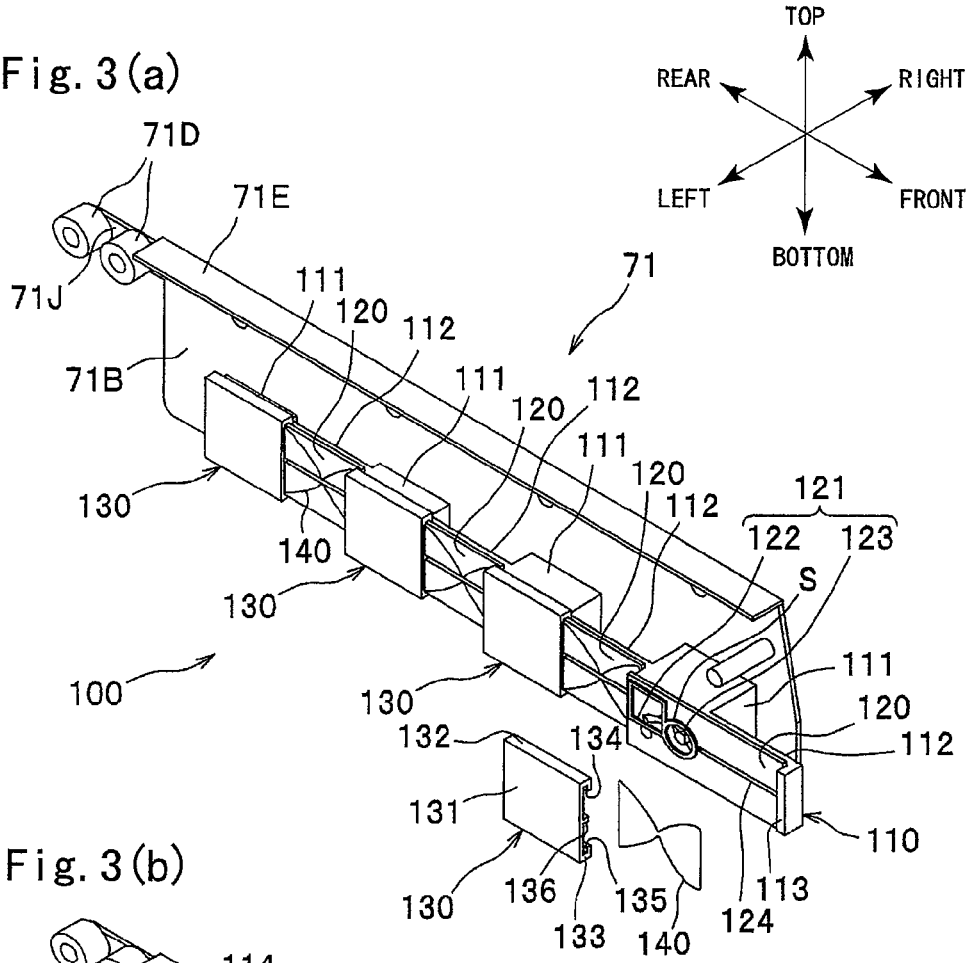
FIG. 3(*a*) is an exploded perspective view showing a closed state of an inlet shutter mechanism in the printer according to the first embodiment.
Figure 3B:
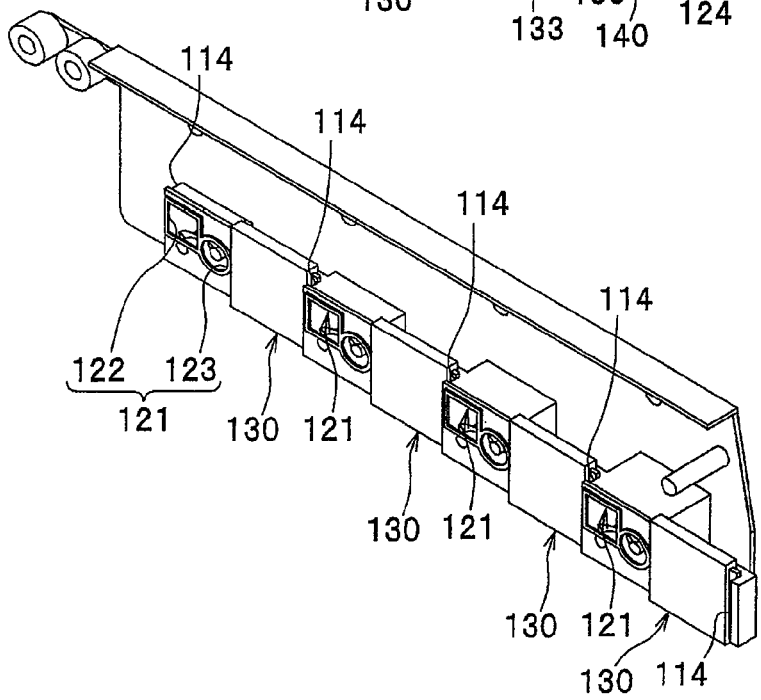

A shutter mechanism will next be described. As shown in FIGS. 3(*a*) and 3(*b*), an inlet shutter mechanism 100 is provided at a lower laterally inner portion of a left side wall 71B of the drawer 71 for opening and closing the plurality of openings 121. The inlet shutter mechanism 100 includes a base member 110 functioning as a second abutment member, four shutter support plates 120, four inlet shutters 130, and four first springs 140 functioning as first biasing members.

The lower portion of the left side wall 71B of the drawer 71 is formed with a plurality of through-holes (not shown) arrayed in frontward/rearward direction at a constant interval. The base member 110 is joined to the lower inner surface of the left side wall 71B of the drawer 71, and includes a plurality of tubular portions 111 and plate-like extension portions 112. Each tubular portion 111 has a rectangular cross-section and protrudes laterally inward from the left side wall 71B so as to box in each through-hole. The tubular portions 111 are arrayed in frontward/rearward direction at a constant interval, and have protruding lengths from the inner surface of the left side wall 77B gradually increased toward the front side of the main frame 2. That is, the rearmost tubular portion 111 has the smallest protruding length, and the front-most tubular portion 111 has the largest protruding length.

Each extension portion 112 integrally extends frontward from each front face of each tubular portion 111, and has a left side surface in flush with a left side surface of the tubular portion 111. Further, each extension portion 112 is integral with each immediate frontward tubular portion 111, and each left side surface of each extension portion 112 is positioned closer to the left side wall 71B than each left side surface of each immediate frontward tubular portion 111 to the left side wall 71B to provide an angled corner 114. Thus, the left side surface of the base member 110 is configured in a staircase pattern so as to gradually increase its height (from the left side wall 71B) toward front side of the frame 2. The front-most extension portion 112 has an extending length equal to that of each remaining extension portions 112. The front-most extension portion 112 has a front end provided with a flange 113 protruding leftward so as to support the front-most first spring 140. The flange 113 can provide a front-most angled corner 114.

The shutter support plate 120 is an elongated rectangular plate like member and has an extending length equal to a total length of each extension portion and a frontward/rearward length of each tubular portion 111 from which each extension portion extends. Further, the shutter support plate 120 has a vertical width greater than that of the extension portion 112 and the tubular portion 111, so that a top side and a bottom side of the plate 120 vertically protrude from upper and lower side surfaces of the extension portion 112, respectively. Each shutter support plate 120 has a rear region formed with passages 121 including an inlet port 122 having a square cross-section and a recirculation port 123 having a circular cross-section at a position in alignment with an interior of each tubular portion 111. Sponges are fixed to each open end of the inlet port 122 and recirculation port 123. Each sponge has a shape in conformance with an outline of each open end.

The shutter support plate 120 is formed with a guide groove 124 extending in frontward/rearward direction. Each guide groove 124 has a front end opened to each front end surface of the shutter support plate 120, and has a rear end at the rear region thereof. Each shutter support plate 120 is joined to each left side surface of each set of the tubular portion 111 and the extension portion 112. Thus, the plurality of the open ends of the passages 121 are offset from each other in the lateral direction (leftward/rightward direction) perpendicular to the attachment/detachment direction of the drawer 71.

The inlet shutter 130 has a generally plate like configuration extending in the frontward/rearward direction (attachment/detachment direction), and slidably movable in the frontward/rearward direction to a first closed position for closing the passages 121 and to a first open position for opening the passage 121.

More specifically, the inlet shutter 130 includes a vertical shutter wall portion 131, and upper and lower engagement portions slidably engageable with the vertically protruding parts of the shutter support plate 120. The upper engagement portion includes an upper wall 132 protruding rightward from the upper edge of the shutter wall portion 131 and an upper pawl 134 protruding downward from the right edge of the upper wall 132. The lower engagement portion includes a lower wall 133 protruding rightward from the lower edge of the shutter wall portion 131 and a lower pawl 135 protruding upward from the right edge of the lower wall 133.

Further, the shutter wall portion 131 has a front region provided with a projection 136 projecting rightward so as to slidably engage the guide groove 124. The projection 136 is abuttable on the rear end of the guide groove 124 to prevent the inlet shutter 130 from further moving rearward relative to the shutter support plate 120.

The first spring 140 is adapted for normally biasing the inlet shutter 130 to its closed position, and is made from a wire rod bent into butterfly shape. That is, the wire rod is bent in rectangle shape, and then each intermediate portion of each opposing major sides of the rectangle is further bent. More specifically, the major side has a length almost twice as large as that of the minor side. Upon compression of the first spring 140, a distance between the minor sides is reduced while each major side is largely bent into a hairpin manner. The first spring 140 has a rear end fixed to the inlet shutter 130 by an adhesive, and a front end fixed to the angled corner 114 of the base member 110.

Figure 4A:
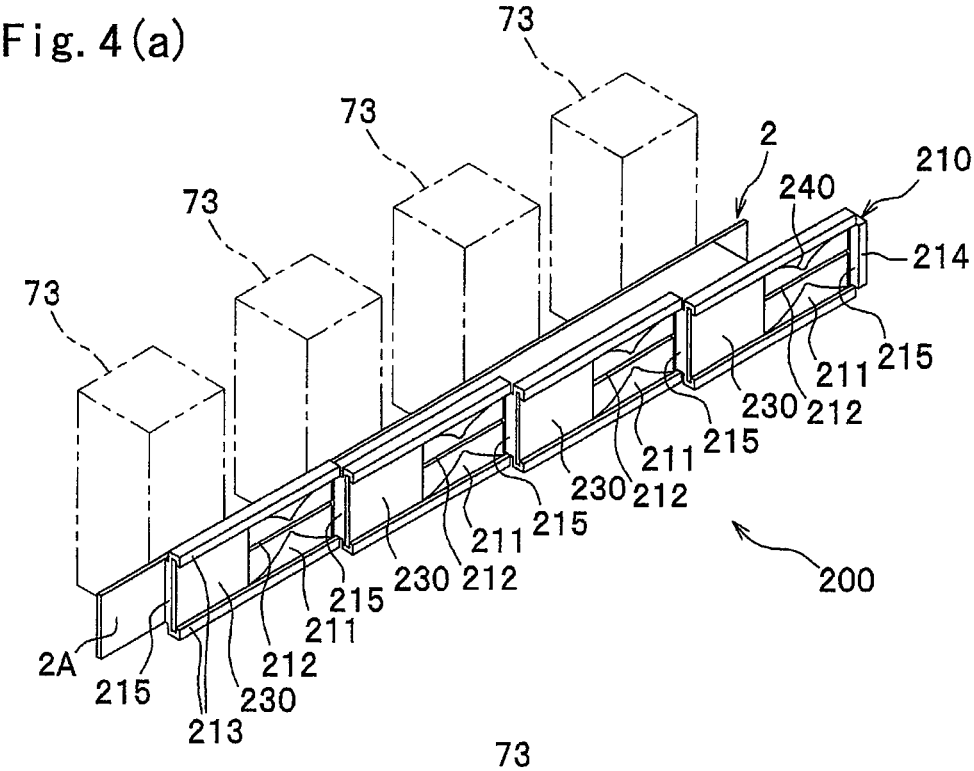
FIG. 4(*a*) is a perspective view showing a closed state of an outlet shutter mechanism at a cartridge side in the printer according to the first embodiment.
Figure 4B:
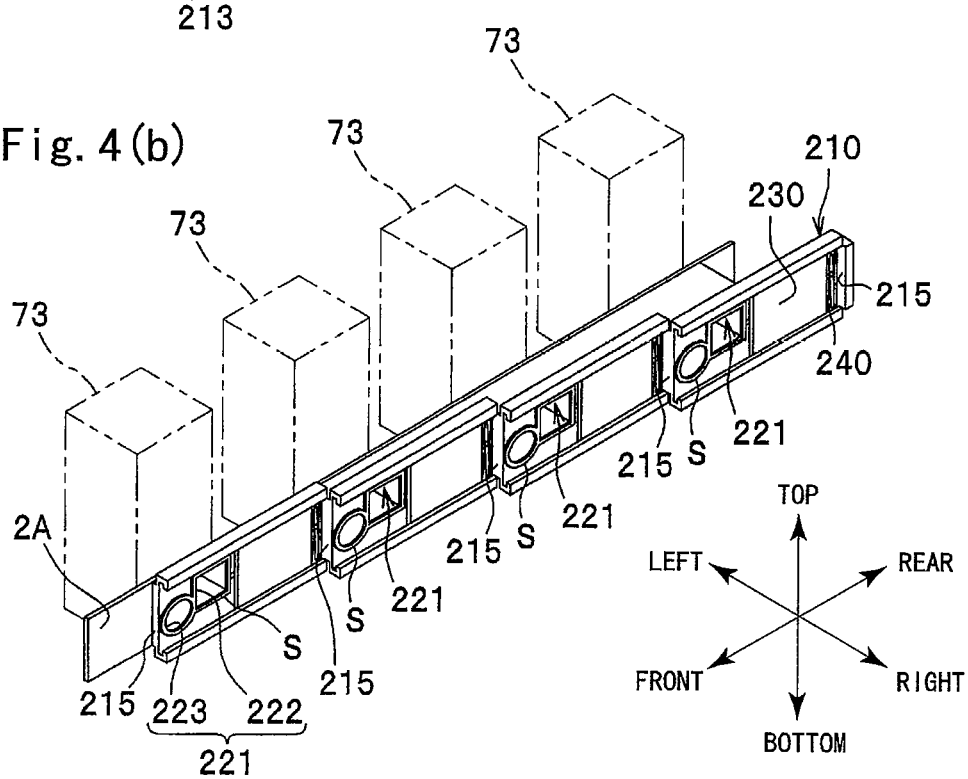

Next, an outlet shutter mechanism 200 will be described with reference to FIGS. 4(*a*) and 4(*b*). The outlet shutter mechanism 200 is provided at the main frame 2 for shutting off the toner supply and enabling the toner supply from each developer cartridge 73 to each developing unit 72 and toner collection from each developing unit 72 to each developer cartridge 73. The outlet shutter mechanism 200 has a structure approximately the same as that of the inlet shutter mechanism 100 provided at the drawer 71, and generally includes a base member 210 functioning as a first abutment member, four outlet shutter 230, and four second spring 240.

The base member 210 is configured in a staircase pattern so as to gradually increase its height (from a wall 2A of the main frame 2) toward the rear side. Thus, four angled corners 215 are provided. That is, the base member 210 has four right side surface sections 211 laterally displaced from one another. Each right side surface section has a rear region formed with a guide groove 212 similar to the guide groove 124 of the shutter support plate 120 of the drawer 71, and has a front region formed with passages 221 penetrating through a thickness of the base member 210 and having configuration the same as the passages 121 at the drawer 71. Thus, passages 221 of all right side surface sections 211 are laterally displaced from one another.

Upper and lower edges of each right side surface section 211 have U-shaped upper and lower rail portions 213, respectively, extending in frontward/rearward direction so as to guide sliding movement of upper and lower edges of each shutter 230. Further, a flange 214 protrudes rightward from a rear end of the rearmost right side surface section 211. A rearmost angled corner 215 is defined at the flange 214.

The passages 221 includes an outlet port 222 having a square cross-section to be fluidly connected to the square inlet port 122 of the drawer 71, and a collection port 223 having a circular cross-section to be fluidly connected to the circular recirculation port 123. Sponges S having configurations in conformance with contours of these ports are adhesively bonded to portion around the ports. Each developer cartridge 73 has a toner discharge part integrally connectable to each outlet port 222 as shown in FIGS. 7(*a*) and 7(*b*). The toner discharge part can be detachable from the outlet port 222 for performing exchange of the developer cartridge 73 with a new cartridge.

Incidentally, the wall 2A of the main frame 2 and the developer cartridges 73 are also formed with passages having configurations the same as those of the passages 221. Thus, the toner in the developer cartridges 73 can be supplied to the developing units 72 through the outlet ports 222 and the inlet ports 122, and the toner in the developing units 72 can be circulated and collected in the developer cartridge 73 through the recirculation ports 123 and the collection ports 223.

Instead of the above-described outlet shutter mechanism 200, any conceivable shutter opening and closing structure is available. For example, an automatic shutter opening structure can be provided that opens the outlet port for the developer cartridge in interlocking relation to assembly of the developer cartridge 73 into the main frame 2 by engagement between the shutter and the main frame 2. Alternatively, a manual operation knob can be provided so that shutters for the developer cartridges can be independently or concurrently operated to open the outlet ports after the developer cartridges 73 are assembled to the main frame 2. Further, each developer cartridge can be provided with a sponge that protrudes outward to provide intimate contact with the wall 2A of the main frame 2 when the outlet ports for the developer cartridges are opened by the shutters.

Each outlet shutter 230 has a generally plate like configuration extending in the attachment/detachment direction of the drawer 71, and is slidably movable in the frontward/rearward direction with respect to the rail portions 213 to a closed position for closing the passages 221 and to an open position for opening the passage 221. Each outlet shutter 230 has a rear region provided with a projection (not shown) protruding leftward and slidingly engaged with the guide groove 212. The projection is abuttable on a front end of the guide groove 212 so as to prevent the outlet shutter 230 from being further moved frontward.

The second spring 240 has a configuration the same as that of the first spring 140 for normally biasing the outlet shutter 230 to the closed position. Each second spring 240 has a front end adhesively bonded to each outlet shutter 230, and has a rear end adhesively bonded to each angled corner 215.

As shown in FIG. 2(*a*), the drawer 71 has a front end provided with an operating portion 71C for manually moving the drawer 71 in the attachment/detachment direction which is the moving direction of the inlet shutters 130. The drawer 71 has an upper portion provided with wheels 71D and flanges 71E.

As shown in FIG. 1, the operating portion 71C includes a pivot shaft 71F fixed to the front end of the drawer 71 and extending in the lateral direction, and a hand grip portion 71G pivotally connected to the pivot shaft 71F and angularly movable in the vertical direction.

The drawer 71 has the upper rear end provided with a pair of extension parts 71J extending rearward therefrom. Two wheels 71D are arrayed in the frontward/rearward direction and are rotatably connected to the respective extension parts 71J. The flanges 71E extend in the frontward/rearward direction and protrude leftward and rightward from the upper left side wall and from the upper right side wall of the drawer 71.

As shown in FIG. 5, the main frame 2 includes a guide unit 24 for supporting the lateral sides of the drawer 71 and guiding the drawer 71 to move to a predetermined position in the main frame 2. (In FIG. 5, only a left side guide unit 24 is shown.) The left side guide unit 24 includes a guide roller 24A, a slant surface section 24B, and a guide rail 24C in this order from the front side.

The guide roller 24A is rotatably provided in the front side of the main frame 2. The guide rail 24C is formed in a plate-shaped and extends horizontally in a frontward/rearward direction. The guide rail 24C has a rear end curved upward. The guide rail 24C has an upper guide surface at a position substantially the same as a lowermost portion of the guide roller 24A in a vertical direction. The slant surface section 24B has a surface which inclines from an uppermost portion of the guide roller 24A to the upper guide surface of the guide rail 24C.

In order to insert the drawer 71 into the main frame 2, the wheels 71D of the drawer 71 is rolled on the guide roller 24A, the slant surface 24B, and the guide rail 24C of the guide unit 24, and is moved rearward. When the wheels 71D of the drawer 71 reach the guide rail 24C, the flange 71E of the drawer 71 is mounted on the guide roller 24A.

As the wheels 71D of the drawer 71 is rollingly moved on the guide rail 24C to move rearward, the flange 71E of the drawer 71 slidably moves rearward in association with the rotation of the guide roller 24A. Thus, the drawer 71 can be moved rearward with a stabilized posture. The rearward movement of the wheels 71D is stopped upon abutment on the upward curved portion of the guide rail 24C, so that the drawer 71 is positioned at a predetermined location (operable position).

Next, developing agent communication and shutoff between the developer cartridges 73 and the developing units 72 will be described with reference to FIG. 5 where the drawer 71 has not been assembled into the main frame 2. In this state, the second front cover 22 opens frontward after the top cover T has opened above. The drawer 71 is then inserted into the predetermined position of the main frame 2 (the position shown in FIG. 6) along the guide unit 24. In accordance with the assembly of the drawer 71 into the main frame 2 as described above, each inlet shutter 130 of the drawer 71 abuts onto each angled corner 215 of the base member 210 of the main frame 2 so that each inlet shutter 130 is relatively moved frontward with respect to the drawer 71 as shown in FIGS. 7A and 7B. At the same time, each angled corner 114 of the base member 110 of the drawer 71 including the rearmost portion of the shutter support plate 120 abuts against each outlet shutter 230 of the main frame 2 so that each outlet shutter 230 is moved rearward.

Figure 8:
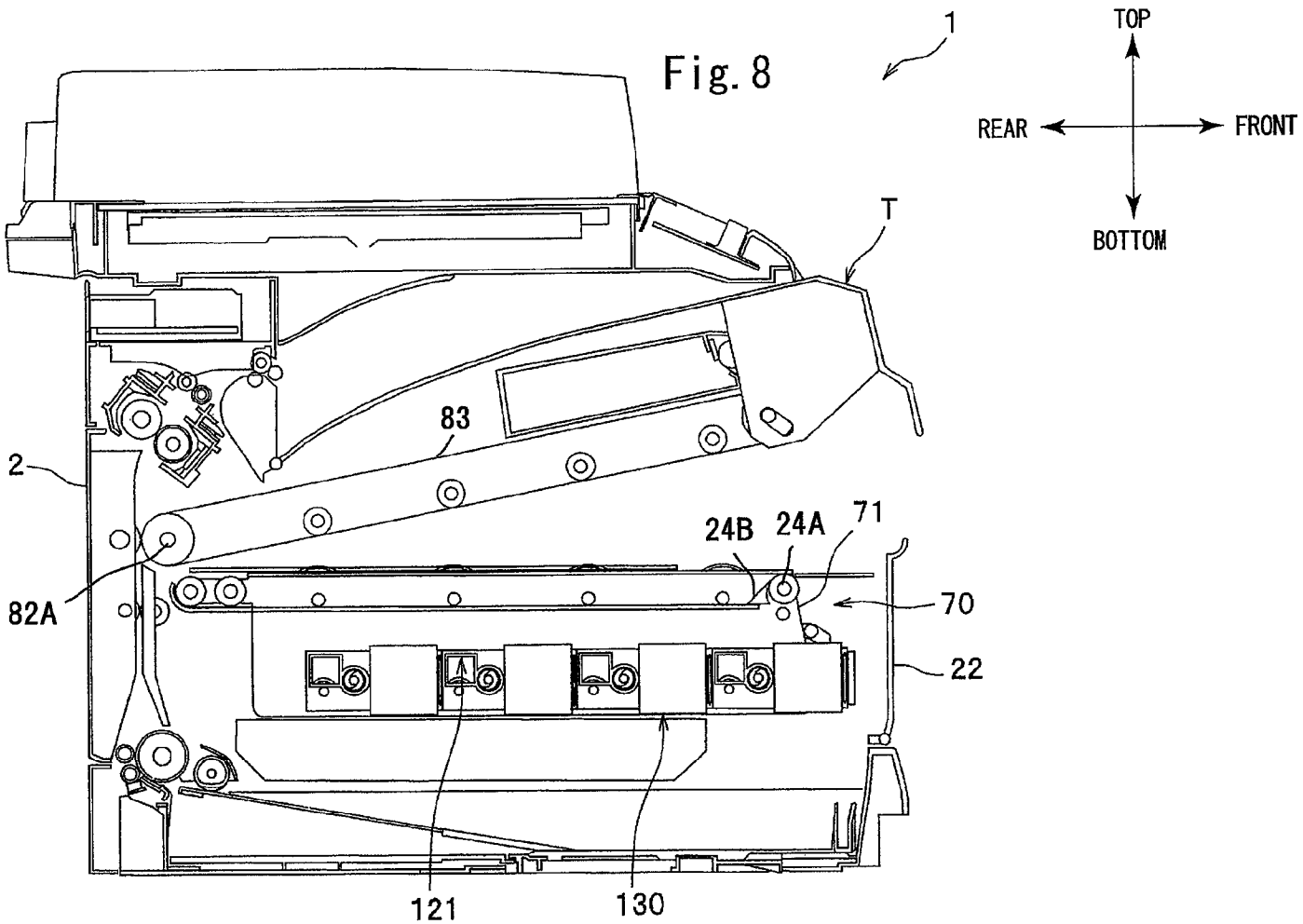
FIG. 8 is a schematic cross-sectional view showing a closed state of a second front cover in the printer according to the first embodiment.

As a result of simultaneous movement of each inlet shutter 130 and each outlet shutter 230 in response to the inserting movement of the drawer 71 into the main frame 2, each passage 121 of the drawer 71 and each passage 221 of the main frame 2 are simultaneously opened for providing fluid communication therebetween. Then as shown in FIG. 8, the second front cover 22 is closed, and the top cover T is closed as shown in FIG. 2(*a*) so that the drawer 71 is completely assembled in the main frame 2.

Disassembly of the drawer 71 from the main frame 2 can be performed in the reverse order. Upon disassembly of the drawer 71, as shown in order of FIGS. 7B and 7A, the inlet shutters 130 and the outlet shutters 230 are respectively brought back to the original closed position by the biasing forces of the first springs 140 and the second springs 240 so that fluid communication between each of the passages 121 and 221 can be shut off.

According to the above-described embodiment, as a result of offsetting positioning of the open ends of the passages 121 (and 221) in the lateral direction, a plurality of the inlet shutters 130 abut onto the base member 210 and a plurality of the outlet shutters 230 abut onto the base member 110 so as to simultaneously open the shutters 130, 230 in accordance with the movement of the drawer 71 toward the operative position. Thus, fluid communication between each of the passages 121 and 221 can be easily provided.

Further, the first springs 140 are provided for urging the inlet shutters 130 toward the closed position. Further, the second springs 240 are provided for urging the outlet shutters 230 toward the closed position. Thus, each shutter can be easily brought to their closed positions by these springs. This is in high contrast to manual closure of each shutter.

Further, each of the inlet shutters 130 is formed in the rectangular plate shaped extending in the frontward/rearward direction, and is positioned offset from each other in the lateral direction. Therefore, the drawer 71 can be downsized in the lateral direction, so that compact laser printer can result. Further, each of the outlet shutters 230 is formed in the rectangular plate shaped extending in the frontward/rearward direction and is positioned offset from each other in the lateral direction. Therefore, the outlet shutter mechanism of the main frame 2 can be downsized in the lateral direction, so that compact laser printer can result.

Further, the process unit 70 has the recirculation port 123 and the main frame 2 has the collection port 223 to be connected to the recirculation port 123. This allows toner to circulate between the developing unit 72 and the developer cartridge 73. Thus, deposition of old toner in the developing unit 72 can be avoided.

A color laser printer according to a second embodiment of the present invention will next be described with reference to FIGS. 9 through 14(*b*) wherein like parts and components are designated by the same reference numerals as those shown in FIGS. 1 through 8.

Figure 9:
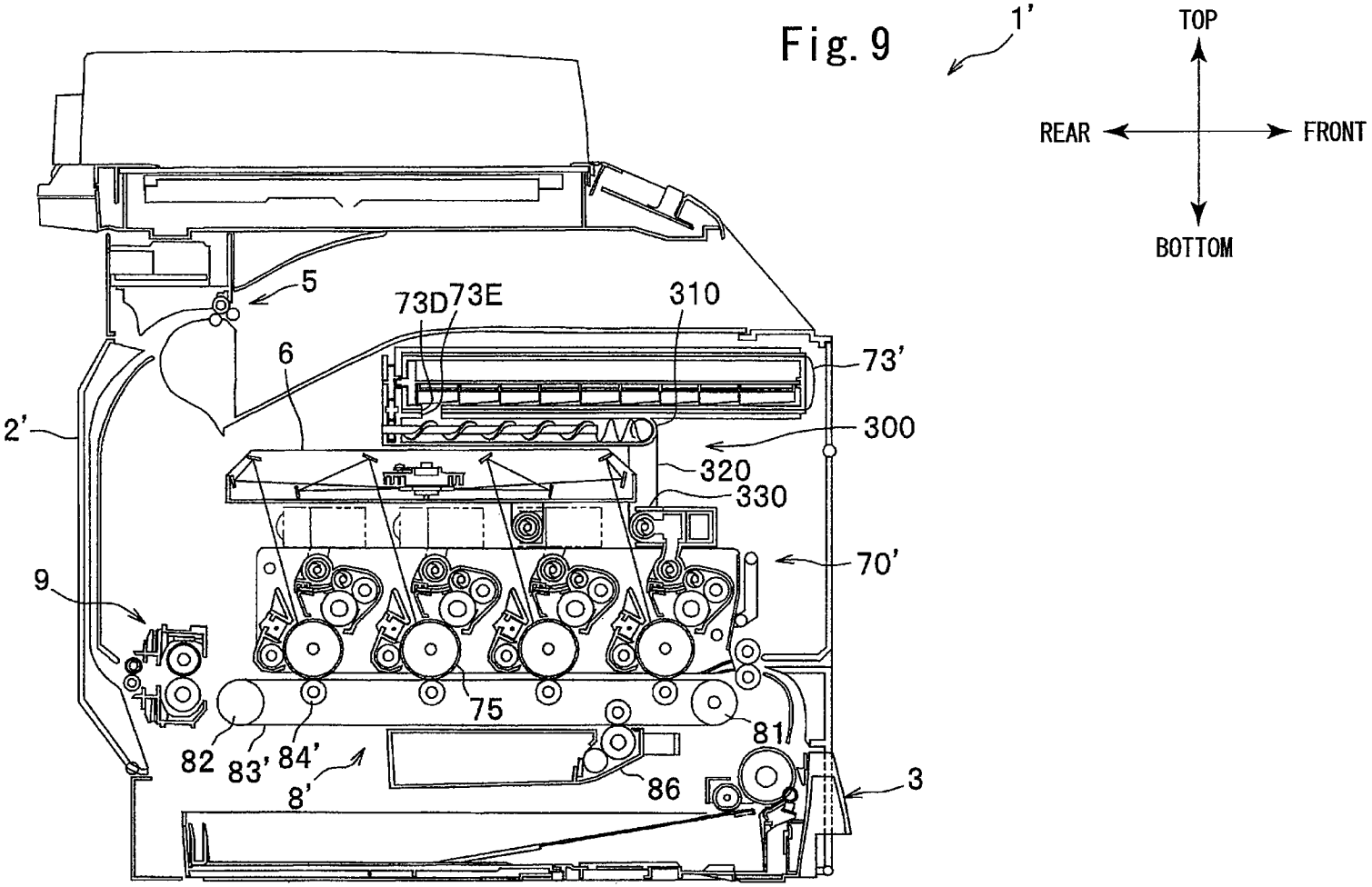
FIG. 9 is a schematic cross-sectional view of a color laser printer embodying an image forming device according to a second embodiment of the present invention.

As shown in FIG. 9, the color laser printer 1' includes a transfer section 8', a process unit 70', developing cartridges 73' and a developing agent supplying unit 300 those being different from those in the first embodiment. The transfer section 8' is similar to the transfer section 8 in the first embodiment, but the secondary transfer roller 85 in the first embodiment is not provided. A sheet supplied from the sheet supply section 3 is conveyed by a conveyor belt 83' corresponding to the intermediate transfer belt 83 of the first embodiment. Toner image on the photosensitive drum 75 is transferred onto the sheet by a transfer bias applied to a transfer roller 84' (corresponding to the primary transfer roller 84 in the first embodiment) when the sheet on the conveyor belt 83' passes through the photosensitive drum 75 of the process unit 70' and the transfer roller 84'.

Figure 10:
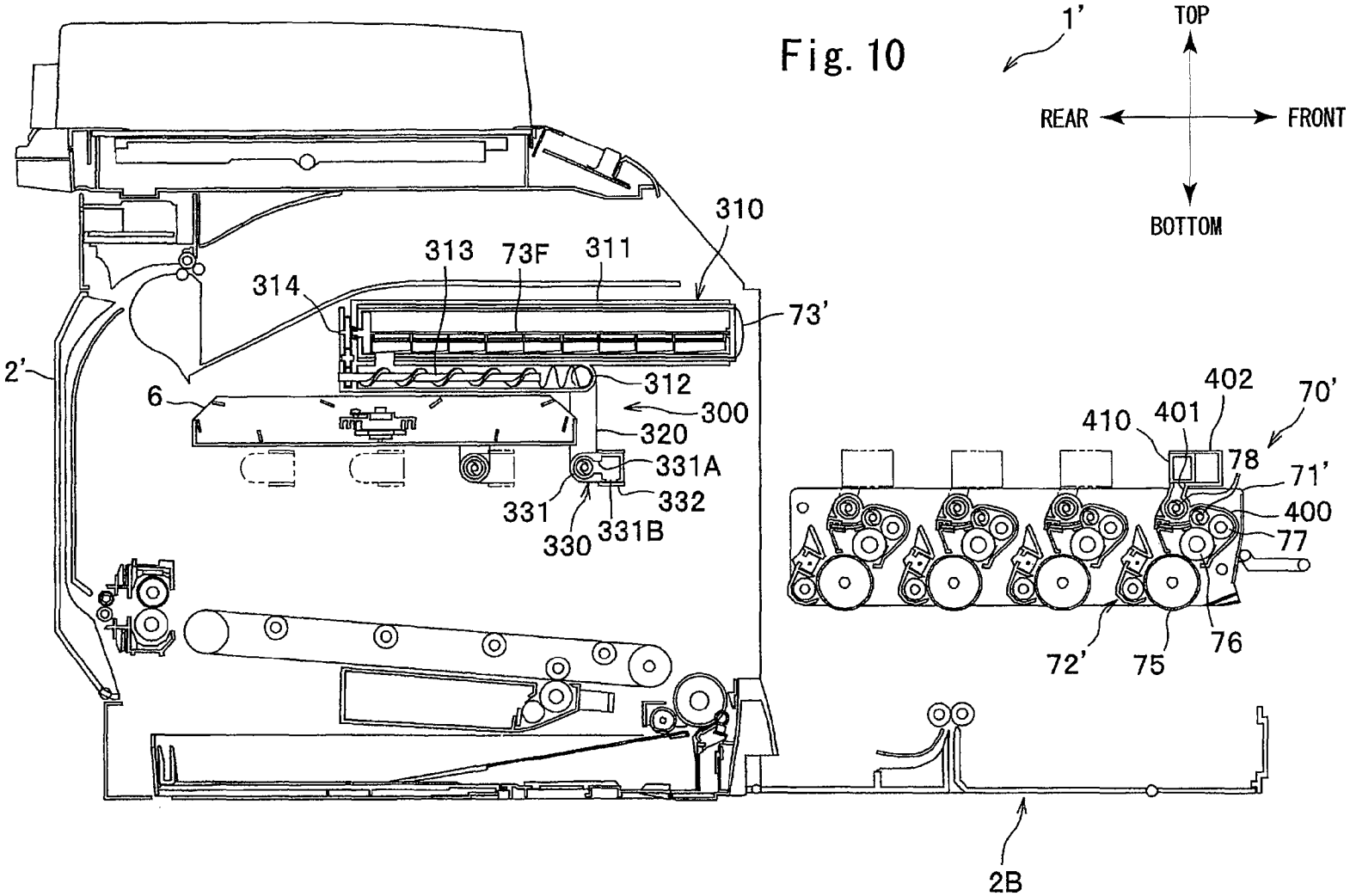
FIG. 10 is a schematic cross-sectional view showing a detachment state of a process unit from a main frame in the printer according to the second embodiment.

As shown in FIG. 10, the process unit 70' includes a drawer 71' and developing units 72' those being different from those of the first embodiment. The drawer 71' is not provided with the inlet shutter mechanism 100 of the first embodiment, but has a top open box shape.

The developing unit 72' includes the photosensitive drum 75, developing roller 76, etc. those being the same as those of the first embodiment, and also includes a developing case 400 different from that of the first embodiment. That is, orientation of the developing case 400 is opposite to that of the first embodiment in that an exposed portion of the photosensitive drum 75 is directed downward. In the developing case 400 two augers 78, 78 are provided, and the developing case 400 is formed with an upwardly open inlet port 401 at a position above one of the augers 78 positioned farther from the toner supply roller 77 than the other auger 78 from the toner supply roller 77. That is, the second embodiment does not provide a structure where the inlet shutter mechanism 100 in the drawer 71 is formed with the inlet port 122 as in the first embodiment, but the second embodiment has the inlet port 401 at the developing unit 72'.

The developing case 400 also includes a shutter support 402 protruding above the drawer 71'. The shutter support 402 has a tubular shape and has a front bottom rear opened configuration, and the inlet port 401 is open to the rear end portion of the shutter support 402. An inlet side shutter 410 is movably provided in the shutter support 402. The inlet side shutter 410 is slidable with respect to an inner surface of the shutter support 402. A spring (not shown) is interposed between the inlet side shutter 410 and the front wall of the shutter support 402 for normally biasing the inlet side shutter 410 to a closed position (a position for closing the inlet port 401).

Figure 11:
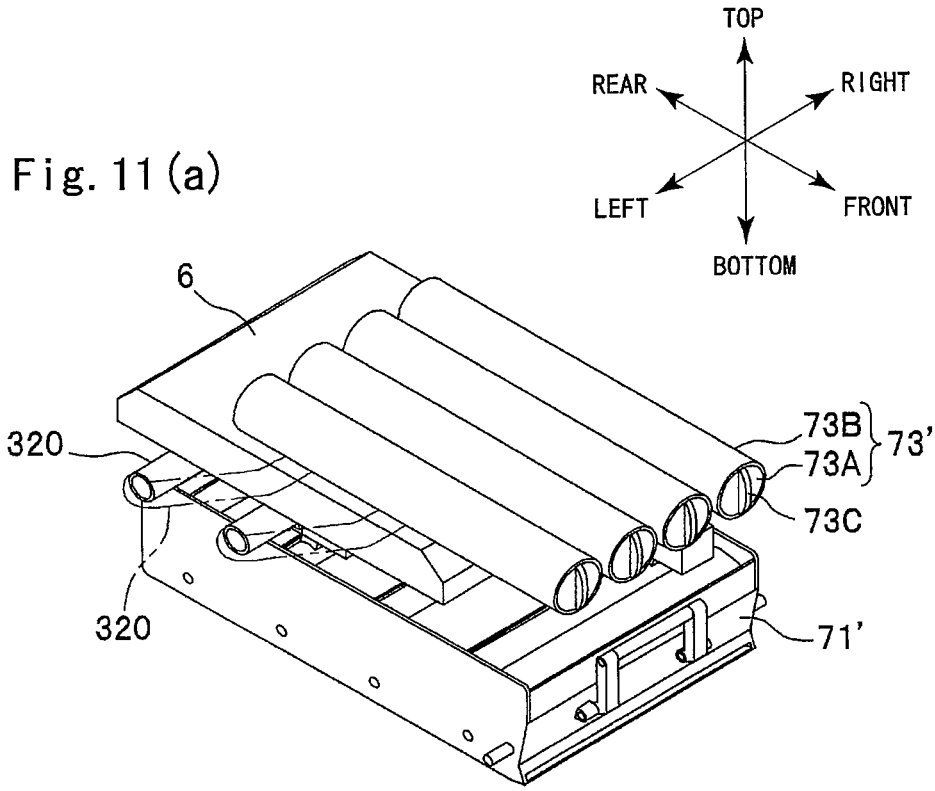
FIG. 11(*a*) is a perspective view of a developer cartridge in the printer according to the second embodiment.
Figure 11:
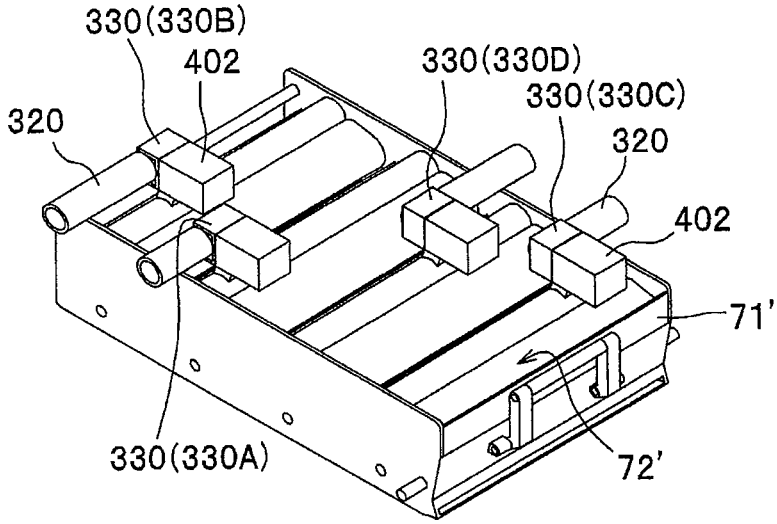

As shown in FIG. 11(*a*), four developer cartridges 73' are disposed above the drawer 71' and each cartridge 73' includes an inner cylindrical member 73A accumulating therein developing agent (toner), and an outer cylindrical member 73B rotatably supporting the inner cylindrical member 73A. The inner cylindrical member 73A has a front end provided with a knob 73C protruding frontward for user's access. As shown in FIG. 9, the inner and outer cylindrical members 73A and 73B have holes 73D, 73E, respectively. Upon rotation of the knob 73C, these holes 73D and 73E are aligned with each other or offset from each other. An auger 73F (FIG. 10) is rotatably disposed in each cartridge 73'.

As shown in FIG. 10, a developing agent supplying unit 300 is fixed to a main frame 2', and includes four main body portions 310, four tubes 320 and four shutter mechanism 330. Each main body portion 310 accommodates therein each developer cartridge 73', and each tube 320 is connected to each main body portion 310. Each shutter mechanism 330 is connected to each end of each tube 320, and each shutter mechanism 330 is connected to each shutter support 402 of the developing unit 72' as shown in FIG. 11(*b*) when the drawer 71' is moved to a predetermined position.

A main body portion 310 is positioned above the scanner unit 6, and includes four accommodating portions 311, four toner receiving portions 312, four augers 313 and a drive mechanism 314. Each accommodating portion 311 accommodates therein each developer cartridge 73'. Each receiving portion 312 is adapted to receive therein toner supplied from each cartridge 73'. Each auger 313 is disposed in each receiving portion 312. The drive mechanism 314 is adapted for rotating the augers 313 and 73F.

Each tube 320 extends from each receiving portion 312 and extends along a lateral side of the scanner unit 6, and is then bent laterally inward for connection to each shutter mechanism 330 as shown in FIG. 11(*b*).

As shown in FIG. 10, each shutter mechanism 330 includes a shutter support 331 fixed to the main frame 2', and an outlet shutter 332 slidably disposed on an outer surface of the shutter support 331. An L-shaped passage 331A is formed in the shutter support 331. The L-shaped passage has a first passage section extending in the frontward/rearward direction for receiving therein toner supplied from the tube 320, and a second passage section bent from the first passage section and extending vertically. An outlet port 331B is formed at a lower front end portion of the second passage section. The outlet shutter 332 is tubular to cover the outlet port 331B and is movable in frontward/rearward direction. A spring (not shown) is provided for normally biasing the outlet shutter 332 to a closed position (for closing the outlet port 331B).

As shown in FIG. 11(*b*), the shutter mechanisms 330 are laterally displaced from each other. More specifically, two rear shutter mechanism 330A, 330B are positioned at a left part of the drawer 71', and the rearmost shutter mechanism 330B is at right side of the remaining rear shutter mechanism 330A. On the other hand, two front shutter mechanisms 330C, 330D are positioned at a right part of the drawer 71', and the front-most shutter mechanism 330C is at right side of the remaining front shutter mechanism 330D. With this arrangement, two tubes 320 take a left roundabout route with respect to the scanner unit 6 regarding the rear shutter mechanisms 330A, 330B, and remaining two tubes 320 take a right roundabout route with respect to the scanner unit 6 regarding the front shutter mechanisms 330C, 330D. Further, four tubes 320 can have lengths equal to one another. As described above, the shutter supports 402 of the developing units 72 are connected to the shutter mechanisms 330 of the developing agent supplying unit 300. To this effect, layout of the shutter supports 402 is the same as the above-described layout of the shutter mechanisms 330. Thus, outlet ports 331B are laterally displaced from one another, and inlet ports 401 are laterally displaced from one another, but can be aligned with respective outlet ports 331B.

Figure 12:
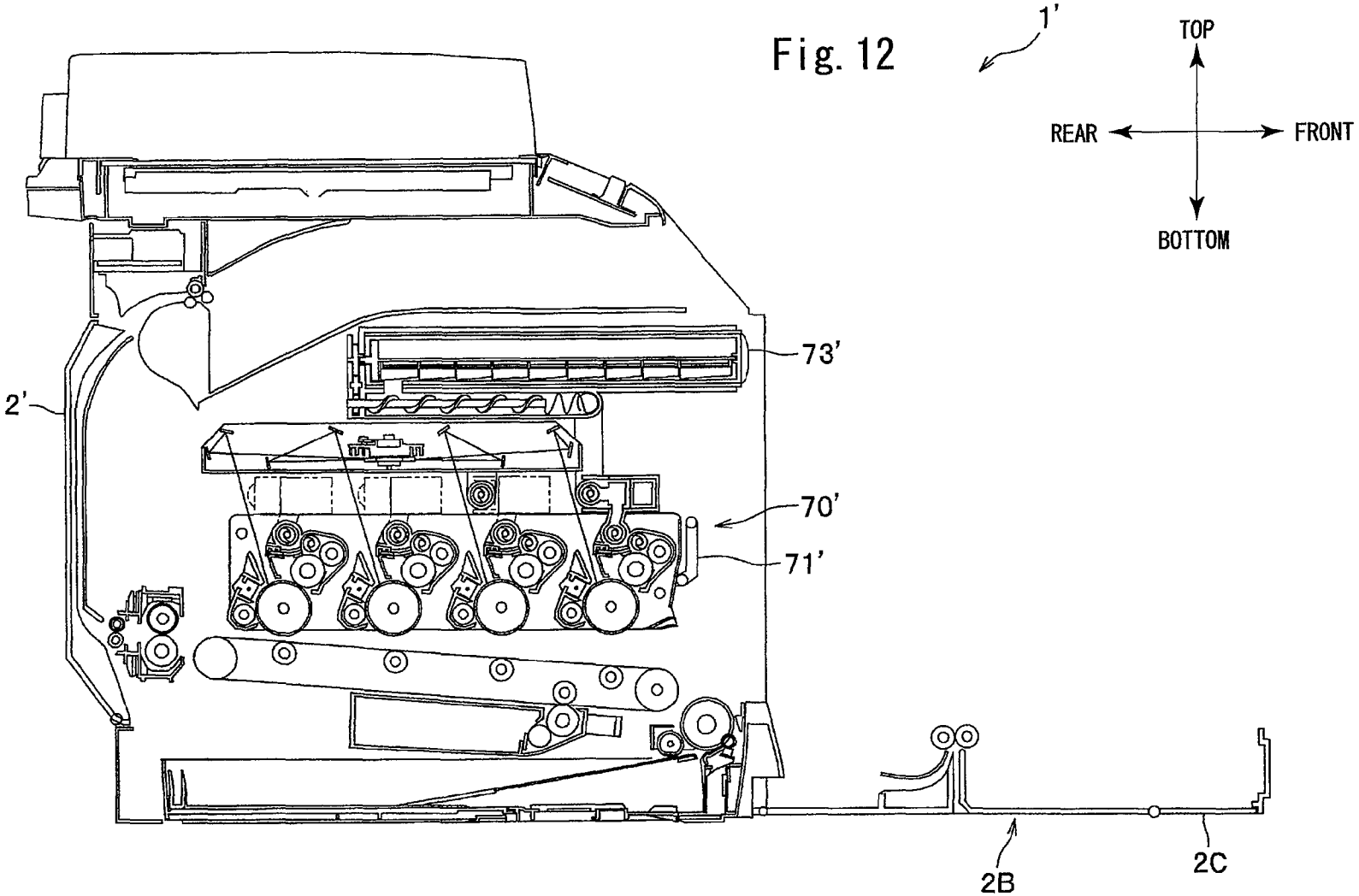
FIG. 12 is a schematic cross-sectional view showing an opening state of a front panel in the printer according to the second embodiment.
Figure 13:
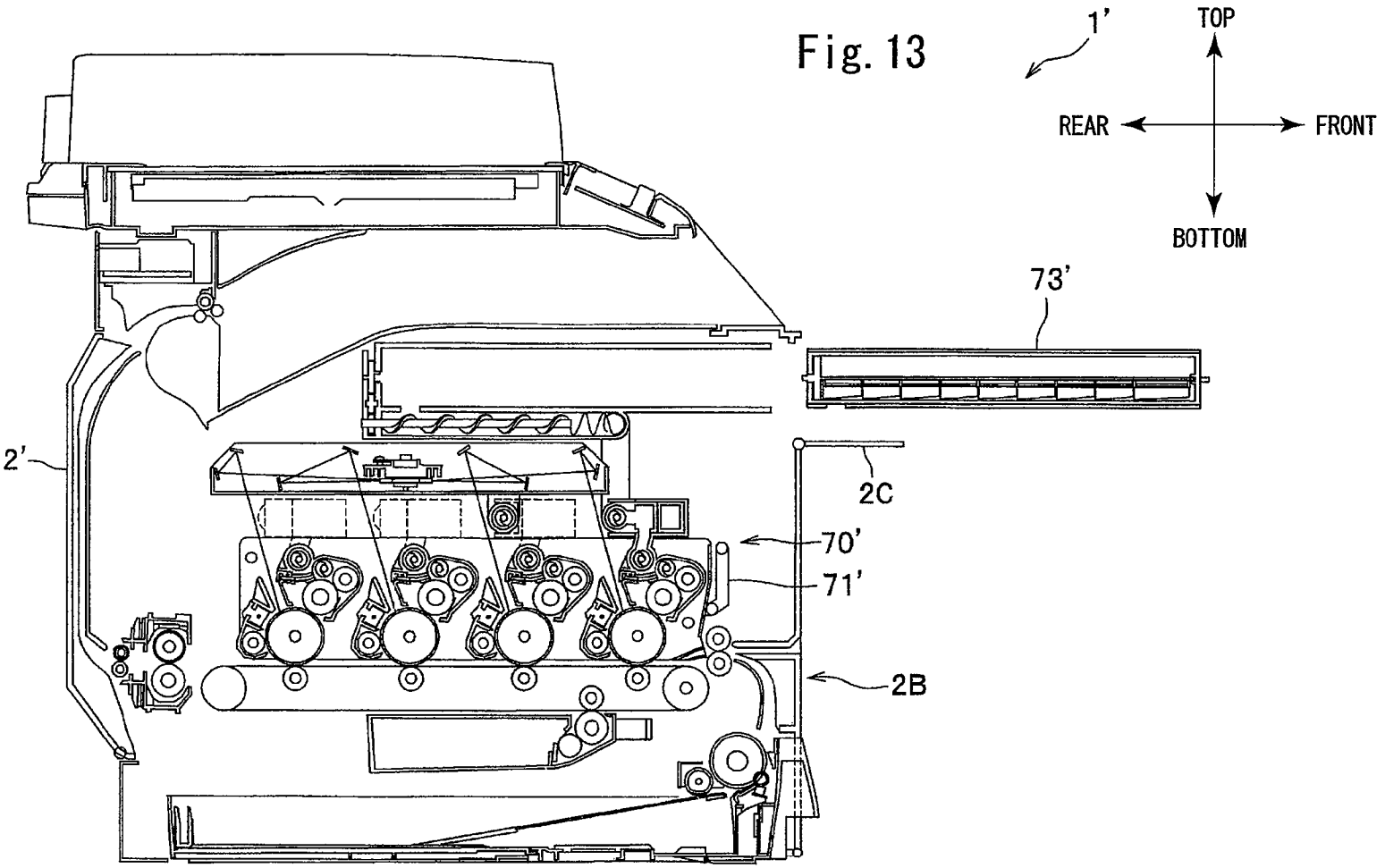
FIG. 13 is a schematic cross-sectional view showing an opening state of a cartridge cover in the printer according to the second embodiment.

As shown in FIG. 12, a front panel 2B is provided at a front side of the main frame 2'. The front panel 2B has a lower end pivotally connected to the main frame 2', so that the front panel 2B can be opened frontward and downward. As shown in FIG. 13, a cartridge cover 2C is pivotally connected to the main panel 2B. By pivotally moving the cartridge cover 2C relative to the front panel 2B, the developer cartridge 73' can be exchanged with a new cartridge. Further, by pivotally moving the front panel 2B, the drawer 71' can be pulled out of the main frame 2'.

Communication between the process unit 70' and the developing agent supplying unit 300 will be described. Prior to assembly of the drawer 71' into the main frame 2' each shutter 410 closes each inlet port 401 of the developing case 400, and each shutter 331 closes each outlet port 331B of each shutter support 331 by the biasing forces of the springs (not shown) as shown in FIG. 14(*a*). As shown in FIG. 12, the drawer 71' can be loaded into a predetermined position of the main frame 2' after opening the front panel 2B. Upon loading, each inlet shutter 410 is pushed frontward by each stationary shutter support 331, and at the same time, each outlet shutter 332 is pushed rearward by each shutter support 402. That is, in the second embodiment, the shutter support 331 of the shutter mechanism 330 functions as the first abutment member, and the shutter support 402 of the developing case 72' functions as the second abutment member.

Thus, the inlet port 401 of the developing case 72' and the outlet port 331B of the shutter mechanism 330 are simultaneously opened to provide fluid communication between the developer cartridge 73' and the developing case 72'. A combination of the shutter support 402 and the inlet shutter 410 can be referred to as the inlet shutter mechanism, and a combination of the shutter support 331 and the outlet shutter 332 can be referred to as the outlet shutter mechanism.

The image forming device according to the second embodiment can provide advantages the same as those of the first embodiment. However, in the second embodiment, the process unit 70' is disposed above the conveyor belt 83', and the plurality of developer cartridges 73' are disposed above the process unit 70'. With this geometrical arrangement, if toner leakage occurs at the time of connection between the inlet ports 401 and the outlet ports 331B, the leaked toner may be dropped onto the sheet P conveyed on the conveyor belt 83' to grime the sheet P. In this connection, the first embodiment is advantageous over the second embodiment in that the plurality of developer cartridges 73' and the process unit 70' are arrayed in a horizontal direction, so that each inlet port and outlet port can be displaced from the conveyor belt 83 in the horizontal direction.

Various modifications are conceivable. For example, in the first embodiment, the outlet port 221 of the main frame 2 is connected to the passage 121 of the inlet shutter mechanism 100 of the process unit 70. Here, the developer cartridge has its own discharge part through which developing agent flows out of the developer cartridge. Each discharge part of each developer cartridge can be directly connected to each inlet port of the process unit without interposition of the outlet port of the main frame. In this case, extreme ends of the discharge parts are offset from each other in the lateral direction for enabling fluid connection to inlet ports offset from each other in the lateral direction.

Further, in the above-described embodiment, the photosensitive drum 75 is provided in the process unit 70, 70'. However, the photosensitive drum 75 can be separate from the process unit. Further, in the above-described embodiments, the outlet ports and inlet ports are laterally displaced from one another. However, the displacing direction can be altered, for example, to vertical direction as long as the displacing direction is perpendicular to the inserting direction of the drawer.

Further, the above-described embodiments pertain to the color laser printer. However, other kinds of image forming device such as a copying machine, a facsimile machine and a multifunction device is also available. Further, instead of the photosensitive drums 75, a belt-like photosensitive body is available.

Further, inventive concept of the above described embodiments can be applied to a fluid coupling device for selectively providing fluid connection between a plurality of supply cartridges and a plurality of receiving cartridges each associated with each supply cartridge. The supply cartridges retain therein fluids different from one another. The fluid may be gas, liquid, powers and a mixture of the liquid and the powder. The developer cartridges 73, 73' in the above described embodiments function as the supply cartridges, and the developing units 72, 72' in the above described embodiments function as the receiving cartridges.

While the invention has been described in detail with reference to the embodiments thereof, it would be apparent to those skilled in the art that various changes and modifications may be made therein without departing from the spirit of the invention.

What is claimed is:

1. An image forming device comprising:

a main body having an opening;

a belt disposed in the main body;

a plurality of developing units arranged along an arrangement direction, each of the plurality of developing units comprising a developing roller defining an axis line; and a supporter configured to support the plurality of the developing units and to move, through the opening of the main body, from an inner side position located at an inner side of the main body to an outer side position located at an outer side of the main body, the supporter comprising:

a first wall having a first passage through which developer is to pass and a second passage through which developer is to pass, the second passage being closer to the opening of the main body than the first passage, and a second wall separated from the first wall in an axial direction parallel to at least one of the axis lines of the developing rollers, the plurality of developing units being disposed between the first wall and the second wall, wherein a distance L1, in the axial direction, between the second passage and an imaginary plane perpendicular to the axial direction and passing the second wall, is greater than a distance L2, in the axial direction, between the first passage and the imaginary plane.

2. The image forming device as claimed in claim 1, wherein:

the first passage is a first opening, and the second passage is a second opening.

3. The image forming device as claimed in claim 2, wherein the supporter further comprises:

a first shutter configured to move, along the arrangement direction of the plurality of developing units, between a first opening position and a first shutting position; and a second shutter configured to move, along the arrangement direction of the plurality of developing units, between a second opening position and a second shutting position, wherein the first shutter is configured to shut the first passage when the first shutter is positioned at the first shutting position and open the first passage when the first shutter is positioned at the first opening position, and wherein the second shutter is configured to shut the second passage when the second shutter is positioned at the second shutting position and open the second passage when the second shutter is positioned at the second opening position.

4. An image forming device comprising:

a main body having an opening;

a belt disposed in the main body;

a plurality of developing units arranged along an arrangement direction, each of the plurality of developing units comprising a developer carrier configured to rotate, for carrying the developer, about an axis line extending along an axial direction; and a supporter configured to support the plurality of the developing units configured to move, through the opening of the main body, from an inner side position located at an inner side of the main body to an outer side position located at an outer side of the main body, the supporter comprising:

a first wall having a first passage through which developer is to pass and a second passage through which developer is to pass, the second passage being closer to the opening of the main body than the first passage, and a second wall separated from the first wall in the axial direction of at least one of the developer carriers, the plurality of developing units being disposed between the first wall and the second wall, wherein a distance L1, in the axial direction of the at least one of the developer carriers, between the second passage and the second wall is greater than a distance L2 between the first passage and the second wall.

5. The image forming device as claimed in claim 4, wherein:

the first passage is a first opening, and the second passage is a second opening.

6. The image forming device as claimed in claim 5, wherein the supporter further comprises:

a first shutter configured to move, along a first direction substantially parallel to the arrangement direction of the plurality of developing units, between a first opening position and a first shutting position; and a second shutter configured to move, along a second direction substantially parallel to the arrangement direction of the plurality of developing units, between a second opening position and a second shutting position, wherein the first shutter is configured to shut the first passage when the first shutter is positioned at the first shutting position and open the first passage when the first shutter is positioned at the first opening position, and wherein the second shutter is configured to shut the second passage when the second shutter is positioned at the second shutting position and open the second passage when the second shutter is positioned at the second opening position.

7. The image forming device as claimed in claim 6, wherein the first direction is parallel to the second direction.

8. The image forming device as claimed in claim 7, wherein the first direction is parallel to the arrangement direction, and the second direction is parallel to the arrangement direction.

9. An image forming device comprising:

a main body having an opening;

a belt disposed in the main body;

a plurality of developing units arranged along an arrangement direction, each of the plurality of developing units comprising a developing roller defining an axis line; and a supporter configured to support the plurality of the developing units configured to move, through the opening of the main body, from an inner side position located at an inner side of the main body to an outer side position located at an outer side of the main body, the supporter comprising:

a first wall having a first passage through which developer is to pass and a second passage through which developer is to pass, the second passage being closer to the opening of the main body than the first passage, and a second wall separated from the first wall in an axial direction parallel to at least one of the axis lines of the developing rollers, the plurality of developing units being disposed between the first wall and second wall, wherein the first passage is disposed at a different position, in the axial direction, from a position where the second passage is disposed.

10. The image forming device as claimed in claim 9, wherein the first passage is a first opening, and the second passage is a second opening.

11. The image forming device as claimed in claim 10, wherein the supporter further comprises:

a first shutter, the first shutter configured to move, along the arrangement direction of the plurality of developing units, between a first opening position and a first shutting position; and a second shutter configured to move, along the arrangement direction, between a second opening position and a second shutting position, wherein the first shutter is configured to shut the first passage when the first shutter is positioned at the first shutting position and open the first passage when the first shutter is positioned at the first opening position, and wherein the second shutter is configured to shut the second passage when the second shutter is positioned at the second shutting position and open the second passage when the second shutter is positioned at the second opening position.

12. An image forming device comprising:

a main body having an opening;

a belt disposed in the main body; and a process unit configured to move, through the opening of the main body, from an inner side position located at an inner side of the main body to an outer side position located at an outer side of the main body, the process unit comprising:

a plurality of developing rollers arranged in an arrangement direction, at least one of the plurality of developing rollers defining an axis line extending along an axial direction, a first wall having a first passage for communication of developer and a second passage for communication of developer, the second passage being closer to the opening of the main body than the first passage, and a second wall separated from the first wall in the axial direction of the at least one of the developing rollers, the plurality of developing rollers being disposed between the first wall and the second wall, wherein a distance L1, in the axial direction of the at least one of the developing rollers, between the second passage and an imaginary plane that is perpendicular to the axial direction and that passes the second wall, is greater than a distance L2, in the axial direction of the at least one of the developing rollers, between the first passage and the imaginary plane.

13. The image forming device as claimed in claim 12, wherein:

the first passage is a first opening, and the second passage is a second opening.

14. The image forming device as claimed in claim 13, wherein the process unit further comprises:

a first shutter, the first shutter configured to move, along the arrangement direction of the plurality of rollers, between a first opening position and a first shutting position; and a second shutter configured to move, along the arrangement direction of the plurality of rollers, between a second opening position and a second shutting position, wherein the first shutter is configured to shut the first passage when the first shutter is positioned at the first shutting position and open the first passage when the first shutter is positioned at the first opening position, and wherein the second shutter is configured to shut the second passage when the second shutter is positioned at the second shutting position and open the second passage when the second shutter is positioned at the second opening position.

15. An image forming device comprising:

a main body having an opening;

a belt disposed in the main body; and a process unit configured to move, through the opening of the main body, from an inner side position located at an inner side of the main body to an outer side position located at an outer side of the main body, the process unit comprising:

a plurality of developer carriers arranged in an arrangement direction, each of the plurality of developer carriers configured to rotate, for carrying developer, about an axis line extending along an axial direction, a first wall having a first passage for communication of developer and a second passage for communication of developer, the second passage being closer to the opening of the main body than the first passage, and a second wall separated from the first wall in the axial direction, the plurality of developer carriers being disposed between the first wall and the second wall, wherein the first passage is disposed at a different position, in the axial direction, from a position where the second passage is disposed.

16. The image forming device as claimed in claim 15, wherein:

the first passage is a first opening, and the second passage is a second opening.

17. The image forming device as claimed in claim 16, wherein the process unit further comprises:

a first shutter, the first shutter configured to move, along the arrangement direction of the plurality of developer carriers, between a first opening position and a first shutting position; and a second shutter configured to move, along the arrangement direction of the plurality of developer carriers, between a second opening position and a second shutting position, wherein the first shutter is configured to shut the first passage when the first shutter is positioned at the first shutting position and open the passage when the first shutter is positioned at the first opening position, and wherein the second shutter is configured to shut the passage when the second shutter is positioned at the second shutting position and open the second passage when the second shutter is positioned at the second opening position.

18. The image forming device as claimed in claim 15, wherein each of the plurality of developer carriers is a developing roller.

* * * * *